US005265774A

United States Patent [19]

Stone

[11] Patent Number: 5,265,774

[45] Date of Patent: Nov. 30, 1993

[54] COAL FEEDER WITH QUICK RELEASE CLEANOUT DOOR

[75] Inventor: Richard B. Stone, Teaneck, N.J.

[73] Assignee: Combustion Engineering, Inc., Windsor, Conn.

[21] Appl. No.: 998,014

[22] Filed: Dec. 29, 1992

[51] Int. Cl.[5] ..... G01F 11/10

[52] U.S. Cl. ..... 222/368; 222/148

[58] Field of Search ..... 222/148, 367, 368; 110/106; 414/219

[56] References Cited

U.S. PATENT DOCUMENTS

| | | | |
|---|---|---|---|
| 1,477,246 | 12/1923 | Conklin | 222/368 |
| 2,498,515 | 2/1950 | Wagner | 222/148 |
| 2,612,299 | 9/1952 | McCabe | 222/367 |
| 3,221,938 | 12/1965 | Yonkers et al. | 222/148 |
| 5,114,053 | 5/1992 | Beirle | 222/368 |

*Primary Examiner*—Andres Kashnikow
*Assistant Examiner*—Philippe Derakshani
*Attorney, Agent, or Firm*—Chilton, Alix & Van Kirk

[57] ABSTRACT

A suction type coal feeder provided with a rear cleanout opening normally closed by a pivotally mounted cleanout door. A quick release mechanism normally clamps the door in its closed position with this mechanism including a pair of brackets mounted on each side of the housing of the feeder. These brackets are secured in place by the mounting bolts for the feed roll plugs that form a part of the feeder and are located at each end of the feed roll that is mounted at this rear portion of the feeder. Studs extend from these brackets in a rearward direction and a clamp bar is pivotally mounted on one of these studs and extends to the other stud which is received in an upwardly extending slot in the clamp bar. The position of the clamp bar is such that it extends across the upper region of the cleanout door and is effective to clamp the door closed by means of handle nuts threaded onto the studs. Loosening of the nuts permits the pivotal removal of the clamp bar and opening of the cleanout door.

2 Claims, 5 Drawing Sheets

COAL FEEDER WITH QUICK RELEASE CLEANOUT DOOR

BACKGROUND OF THE INVENTION

This invention relates to coal feeders that control the flow of coal to pulverized coal fired power plants with the feeder being interposed between the coal bunker and the pulverizer. The invention has particular relation to such feeders that operate under suction with the feeder being provided with an improved quick release rear cleanout door.

In the operation of these suction type coal feeders, it is necessary to periodically gain access to the rear of the feeder in order to clean out debris which collects over time and tends to jam the feeder. For this purpose, there is provided at the rear of the feeder a cleanout door which, in the conventional installation, is held in its closed position by a multiplicity of clamps with access to the interior of the feeder being gained only after release of all of these clamps. While this is an operable arrangement, it has been found, at least in some instances, that the feeder is operated with these clamps permanently disconnected in order to reduce the time required for entry into the feeder for cleanout purposes. While the feeder will operate this way with the door remaining closed due to the suction within the feeder, this is an unsatisfactory operating condition because of the inherent problems encountered should the pulverizer experience a pressure excursion which will back up into the feeder causing the rear door to be blown open possibly damaging the door and its hinges and venting gases onto the operating floor of the power plant.

SUMMARY OF THE INVENTION

It is an object of the present invention to provide an improved arrangement wherein there is a quick release clamping mechanism for securing in place the cleanout door of the coal feeder while permitting fast entry into the feeder when desired. The arrangement is such that the clamping mechanism can be mounted on the feeder in an expeditious and simple manner utilizing fastenings that are already a part of the feeder mechanism. The invention includes two brackets, one of which is secured to each side of the coal feeder by means of the bolts that fasten in place the feed roll plugs of the feeder. These brackets support studs that extend beyond the rear end of the feeder with a clamp bar extending across these studs at the upper region of a cleanout door for the feeder. The door is pivoted at its lower end to the rear end of the feeder and the door is normally maintained in its closed position by means of handle nuts threaded on the ends of the studs to urge the clamp bar against the upper region of the door. The bar is slotted to receive one of the studs and is pivotally mounted on the other stud.

DESCRIPTION OF THE PREFERRED EMBODIMENT

Figure 1:
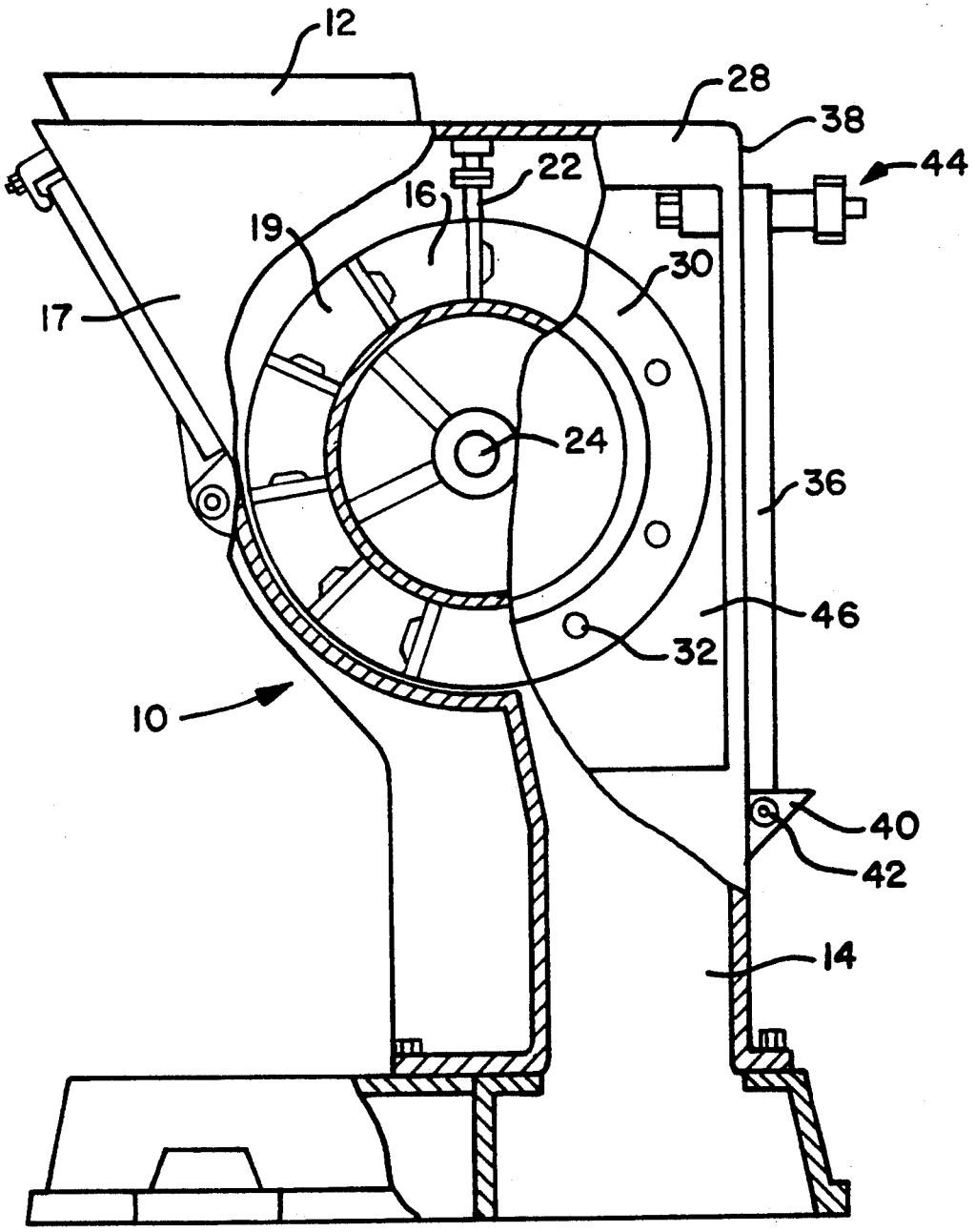
FIG. 1 is a side view of the suction type coal feeder with the wall being partially broken away so that some of the interior mechanism of the feeder can be shown.

Referring now the drawings wherein like reference characters are used throughout to designate like elements, there is depicted in FIG. 1 the coal feeder 10 that operates under suction, i.e. subatmospheric pressure, and has for its purpose the control of the feed of coal to the pulverizer of a power plant. The coal is received from a coal bunker through the opening 12 and is discharged to the pulverizer through the outlet 14. It is conveyed through the housing 17 of the feeder by means of a feed roll which is the rotating pocket assembly 16 with the pockets 19 being driven by the shaft 24 which is connected to appropriate drive and control means. As illustrated, there is provided at the upper region of the feeder a pivoting leveling gate 22.

Figure 2:
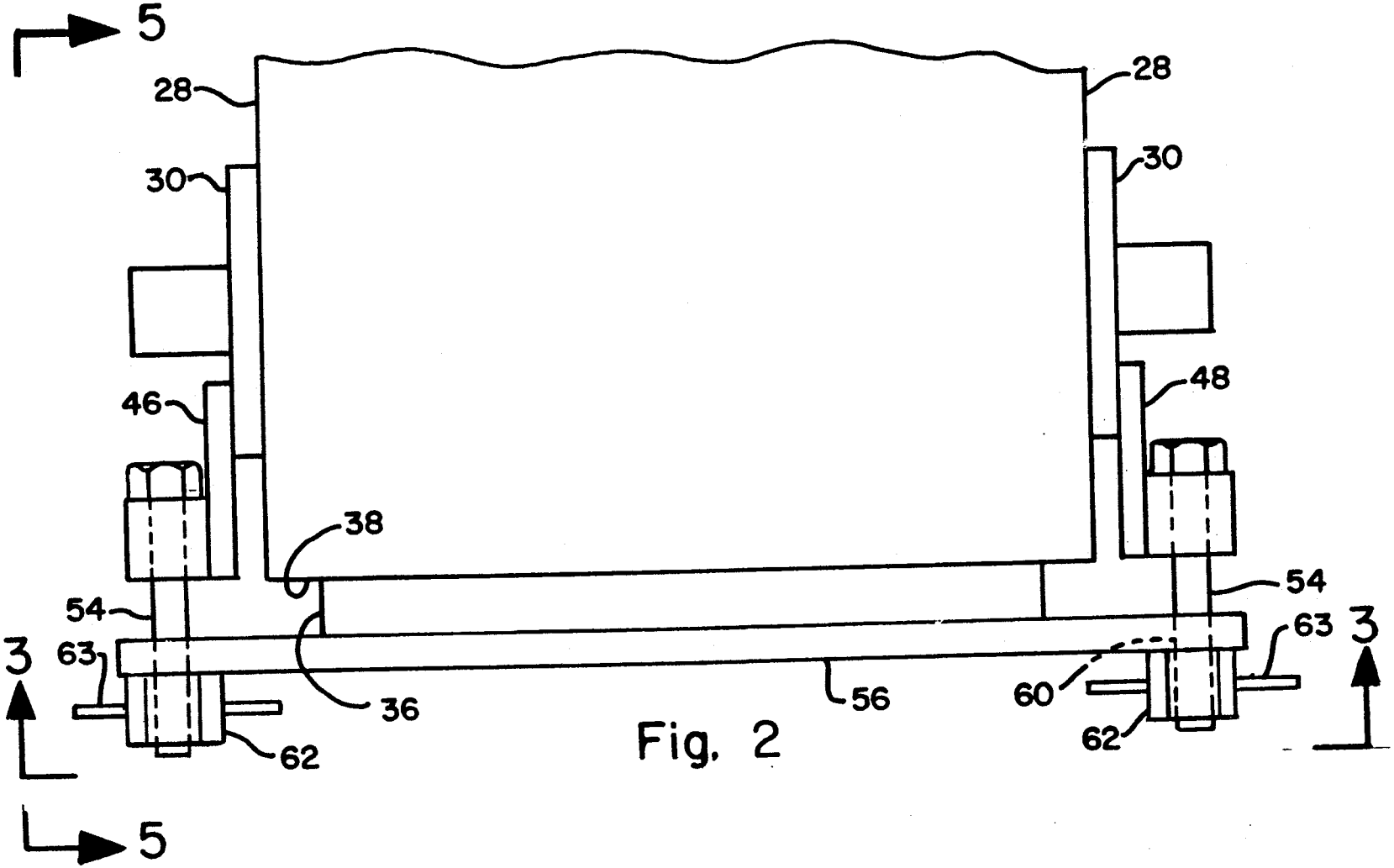
FIG. 2 is a top view of the rear portion only of the feeder showing the quick release clamp mechanism for securing in place the cleanout door of the feeder.
Figure 3:
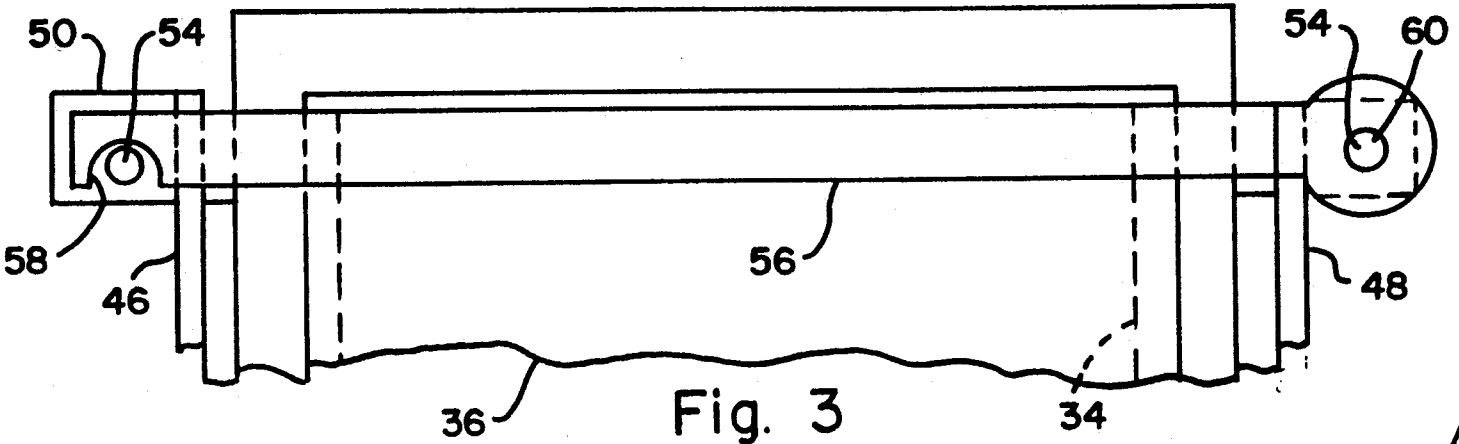
FIG. 3 is a view taken from line 3—3 of FIG. 2 showing the upper portion only of the rear of the feeder.
Figure 4:
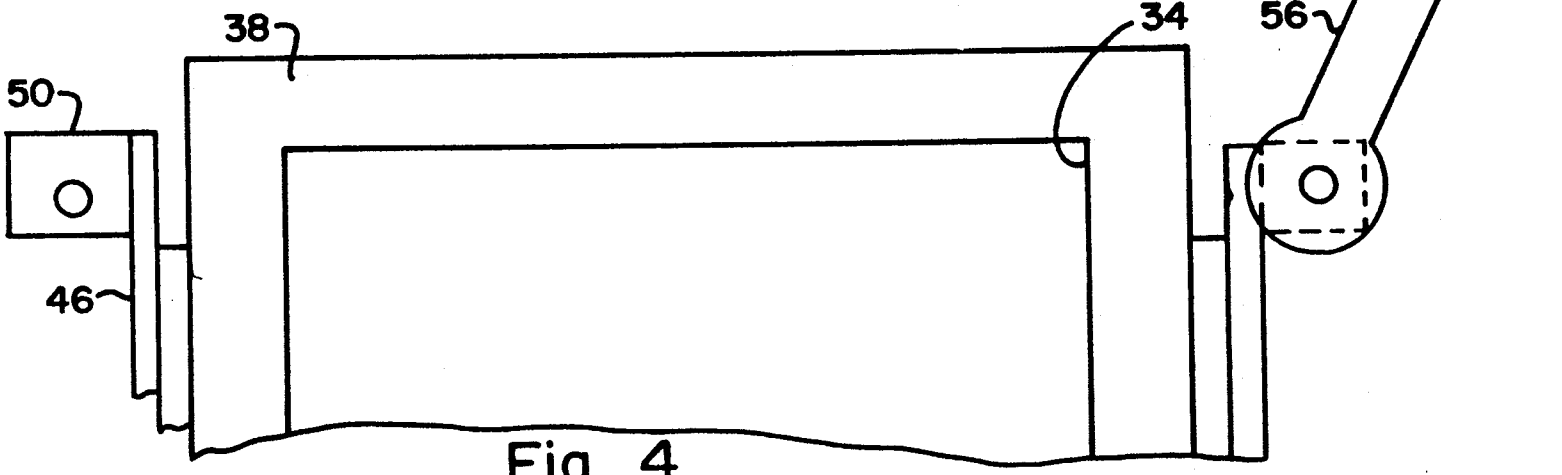
FIG. 4 is a view similar to FIG. 3 with the clamp bar pivoted as shown and with the cleanout door having been moved to its open position.
Figure 5:
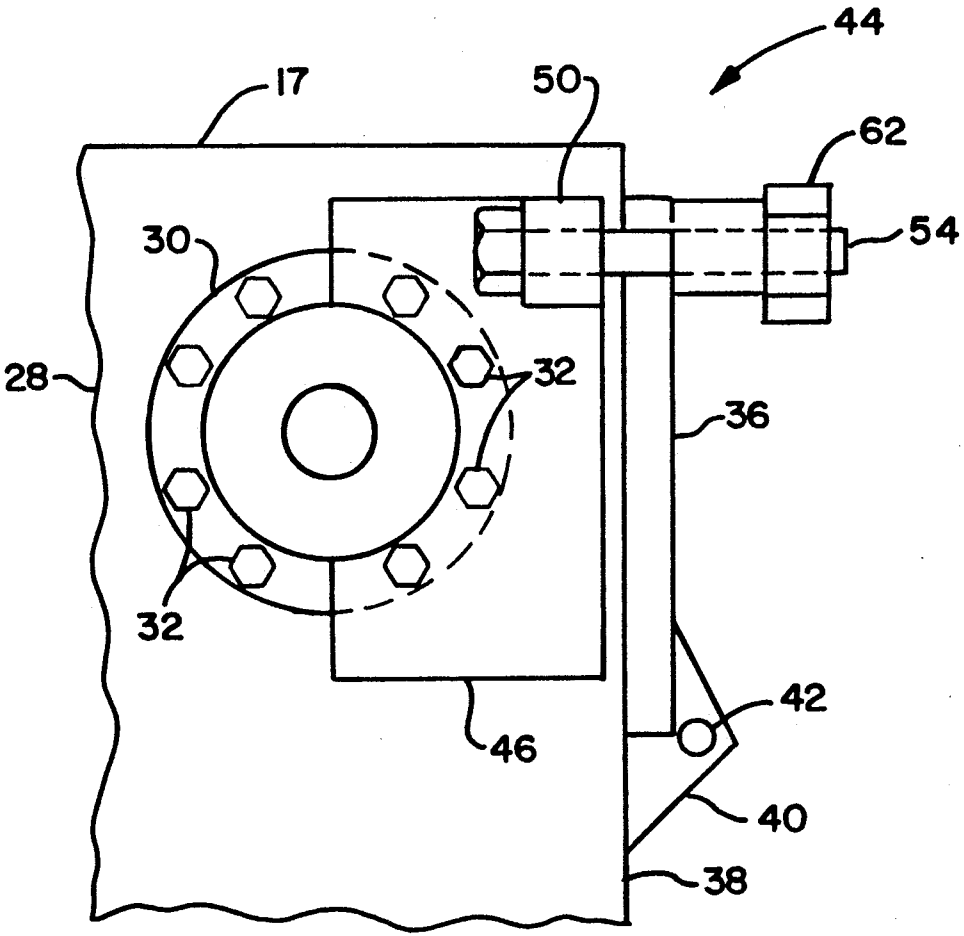
FIG. 5 is a side view of the upper rear portion of the feeder showing the feed roll plug of the feeder and the mounting for the quick release clamping mechanism for the cleanout door.
Figure 7:
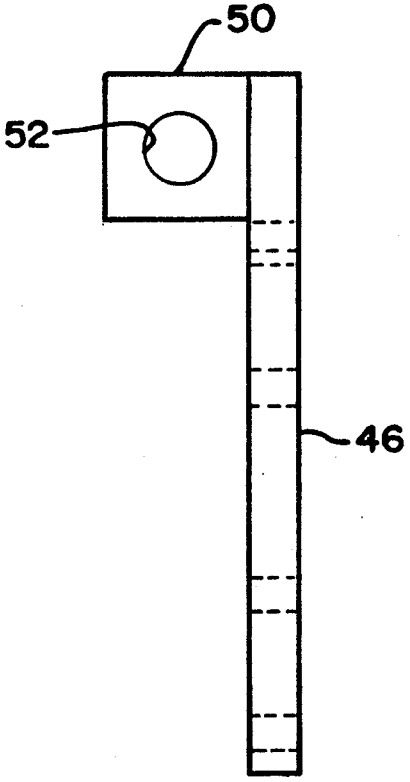
FIGS. 6 and 7 are detailed views of one of the brackets that forms a part of the quick release clamping mechanism of the invention.

The rotating pocket assembly 16 is mounted inside the housing and rotates with the feed roll shaft 24 which is mounted transversely of the feeder housing. At each end of the feed roll shaft, the wall 28 of the feeder housing is formed with a circular opening which is closed by means of a feed roll end plug 30 best shown in FIGS. 2 and 5. The feed roll plugs 30 are secured in place to the outer surface of the wall 28 of the feeder housing by means of bolts 32 disposed in a circular pattern as shown in FIGS. 1 and 5. There is provided at the rear of feeder 10 a cleanout opening 34 as shown in FIGS. 3 and 4. This opening is normally closed by means of the cleanout door or plate 36 which is designed to generally sealingly engage the rear wall 38 of the feeder housing.

Figure 6:
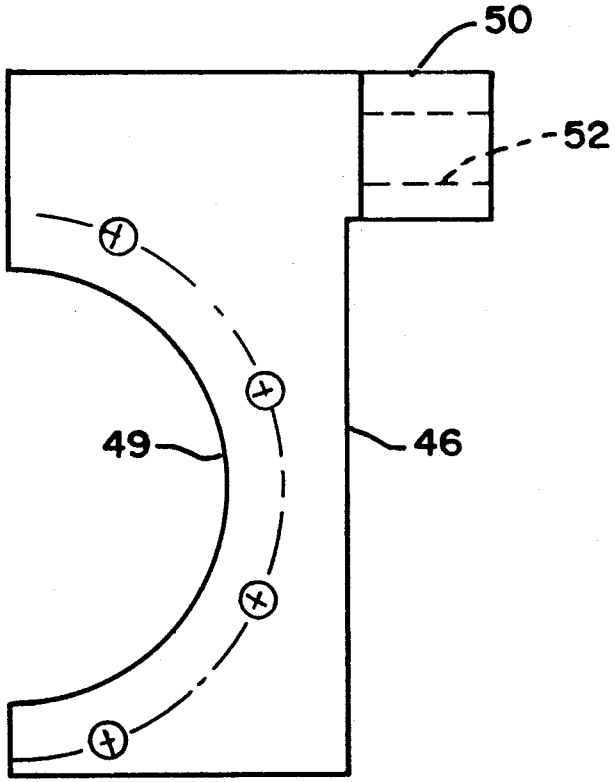

The cleanout door 36 is pivotally mounted at its lower end by means of the support brackets 40 and pivotal shaft 42 (FIGS. 1 and 5) such that it may pivot about a horizontal axis to and from its open and closed positions. The door is normally held in its closed position in engagement with the wall 38 by means of the quick release mechanism 44. This mechanism includes the brackets 46 and 48 mounted on opposite sides of the feeder housing with the brackets having a semicircular recess 49 as shown in FIG. 6 and with a bolt hole pattern corresponding to that of the feed roll plugs. Thus, these brackets are secured in place by the same bolts 32 that hold the feed roll plugs in place. The brackets are provided with a laterally offset portion 50 which is suitably bored at 52 and within which is mounted the high strength stud 54. Each of the studs 54 extends beyond the end wall of the feeder housing and is normal to the plane of the end wall. Extending between these studs is the clamp bar 56 with this bar being slotted at 58 to receive the stud on the left as depicted in FIGS. 2 and 3 and with it being provided with an opening 60 to pivotally receive the stud on the right as viewed in these figures. The studs are so disposed that with the clamp bar 56 closed and extending between the studs, it extends across the upper region of the cleanout door 36 when the door is in its closed position. This bar is effective to clamp the door in its closed position by means of the manually operable handle nuts 62 threaded on to the outer end of the studs 54 with the studs being threaded, preferably with a coarse thread for this purpose. The handle nuts 62 have laterally extending elements 63 of sufficient length that the nuts may be tightened and loosened by hand.

The arrangement of the invention is such that to provide access to the interior of the feeder for cleanout purposes, it is only necessary to loosen the two hand operated handle nuts 62 and then pivot the clamp bar 56 out of the way (FIG. 4) so that door 36 can be opened.

Accordingly, with the invention, there is provided a quick release mechanism for securing cleanout door 36 in its closed position with the mechanism providing fast entry into the interior of the feeder 10 and with the mechanism being simple to construct and install.

I claim:

1. A coa[1] feeder of the type normally operating under suction and having a housing within which is mounted a feed roll on a feed roll shaft, openings being provided in the housing generally coaxial of the feed rolls at each end of the feed roll shaft and feed roll end plugs mounted in said openings and bolted to said housing to close each of said openings and support said feed roll shaft, said housing having at one end a cleanout opening in a generally vertically disposed end wall, a door normally closing said opening, said door including a plate member mounted on the end wall of the housing for pivotal movement about a horizontal axis at the bottom of the plate member to and from an open position and a closed position where it sealingly engages the end wall of the housing, means at the upper end of the door for releasably retaining it in its closed position including a pair of support brackets, one on each side of the housing, retained in position by the bolts that hold the feed roll end plugs in place, the brackets having a laterally outward extending position suitably bored to receive a high strength stud extending normal to the plane of the housing end wall with the axes of the studs being below the upper end of the plate member, said studs extending beyond the end of the housing and outwardly of the plate member, a clamp bar extending between said studs having a slot extending up from its lower edge at one end to loosely receive one of the studs and being pivotally mounted on the other stud, and threaded handle nuts mounted on the outer threaded end of the studs for releasably clamping the plate member in its closed position.

2. The apparatus of claim 1 wherein said feed roll end plugs are of generally circular configuration and are secured to the outer surface of the feeder housing with the bolts securing the same in place distributed in spaced relation about a circle of predetermined radius and with each of said brackets having correspondingly arranged bolt holes extending generally throughout a semi-circle and a relieved portion of somewhat smaller radius.

* * * * *